US009084315B2

(12) United States Patent
Hsu et al.

(10) Patent No.: US 9,084,315 B2
(45) Date of Patent: Jul. 14, 2015

(54) LIGHT-EMITTING DIODE LIGHTING DEVICE HAVING MULTIPLE DRIVING STAGES

(71) Applicant: IML International, Grand Cayman (KY)

(72) Inventors: Horng-Bin Hsu, Taipei (TW); Yi-Mei Li, New Taipei (TW)

(73) Assignee: IML International, Ugland House, Grand Cayman (KY)

( * ) Notice: Subject to any disclaimer, the term of this patent is extended or adjusted under 35 U.S.C. 154(b) by 0 days.

(21) Appl. No.: 14/267,916

(22) Filed: May 2, 2014

(65) Prior Publication Data

US 2015/0015164 A1 Jan. 15, 2015

Related U.S. Application Data

(60) Provisional application No. 61/844,438, filed on Jul. 10, 2013.

(51) Int. Cl.
*H05B 33/08* (2006.01)

(52) U.S. Cl.
CPC ..... *H05B 33/0809* (2013.01); *H05B 33/0815* (2013.01); *H05B 33/0845* (2013.01)

(58) Field of Classification Search
USPC ..... 315/185 S, 312–326, 291, 307, 224, 315/209 R
See application file for complete search history.

(56) References Cited

U.S. PATENT DOCUMENTS

2012/0146519 A1* 6/2012 Briggs ..... 315/192
2012/0256550 A1* 10/2012 Akiyama ..... 315/187
2013/0200812 A1* 8/2013 Radermacher et al. ..... 315/186

* cited by examiner

*Primary Examiner* — Tuyet Vo
(74) *Attorney, Agent, or Firm* — Winston Hsu; Scott Margo

(57) ABSTRACT

An LED lighting device includes multiple driving stages. A first driving stage includes a first luminescent device driven by a first current, a second luminescent device driven by a second current, a path-controller for conducting a third current, a first current controller for regulating the first current, and a second current controller for regulating the second current. The second driving stage includes a third current controller coupled in series to the first driving stage and configured to conduct and regulate a fourth current. When the path-controller is turned off, the third current is zero, and the fourth current is equal to the sum of the first current and the second current. When the path-controller is turned on, the first current, the second current, the third current and the fourth current is equal.

15 Claims, 8 Drawing Sheets

LIGHT-EMITTING DIODE LIGHTING DEVICE HAVING MULTIPLE DRIVING STAGES

CROSS REFERENCE TO RELATED APPLICATIONS

This application claims the benefit of U.S. provisional application No. 61/844,438 filed on Jul. 10, 2013.

BACKGROUND OF THE INVENTION

1. Field of the Invention

The present invention is related to an LED lighting device having multiple driving stages, and more particularly, to an LED lighting device having multiple driving stages for providing wide effective operational voltage range without causing image flicker and uniformity issue.

2. Description of the Prior Art

Compared to traditional incandescent bulbs, light-emitting diodes (LEDs) are advantageous in low power consumption, long lifetime, small size, no warm-up time, fast reaction speed, and the ability to be manufactured as small or array devices. In addition to outdoor displays, traffic signs, and liquid crystal display (LCD) for various electronic devices such as mobile phones, notebook computers or personal digital assistants (PDAs), LEDs are also widely used as indoor/outdoor lighting devices in place of fluorescent of incandescent lamps.

An LED lighting device is normally driven by a rectified alternative-current (AC) voltage and adopts a plurality of LEDs coupled in series in order to provide required luminance. In a conventional method for driving an LED lighting device, the LEDs may be light up in steps in order to increase the effective operational voltage range. The LEDs which are turned on more frequently are aged faster than those which are turned on less frequently, thereby causing uniformity issue. Image flicker may also occur at low rectified AC voltage when not all LEDs are light up. Therefore, there is a need for an LED lighting device capable of improving the effective operational voltage range without causing image flicker and uniformity issue.

SUMMARY OF THE INVENTION

The present invention provides an LED lighting device having a first driving stage and a second driving stage. The first driving stage includes a first luminescent device for providing light according to a first current; a second luminescent device for providing light according to a second current; a first current controller coupled in series to the first luminescent device and configured to regulate the first current so that the first current does not exceed a first value; a second current controller coupled in series to the second luminescent device and configured to regulate the second current so that the second current does not exceed a second value; a first path-controller configured to conduct a third current and comprising a first end coupled between the second luminescent device and the second current controller; and a second end coupled to the first current controller. The second driving stage includes a third current controller coupled in series to the first driving stage and configured to conduct a fourth current and regulate the fourth current so that the fourth current does not exceed a third value. When the first path-controller is turned off, the third current is zero, and the fourth current is equal to a sum of the first current and the second current. When the first path-controller is turned on, the first current, the second current, the third current and the fourth current is equal.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
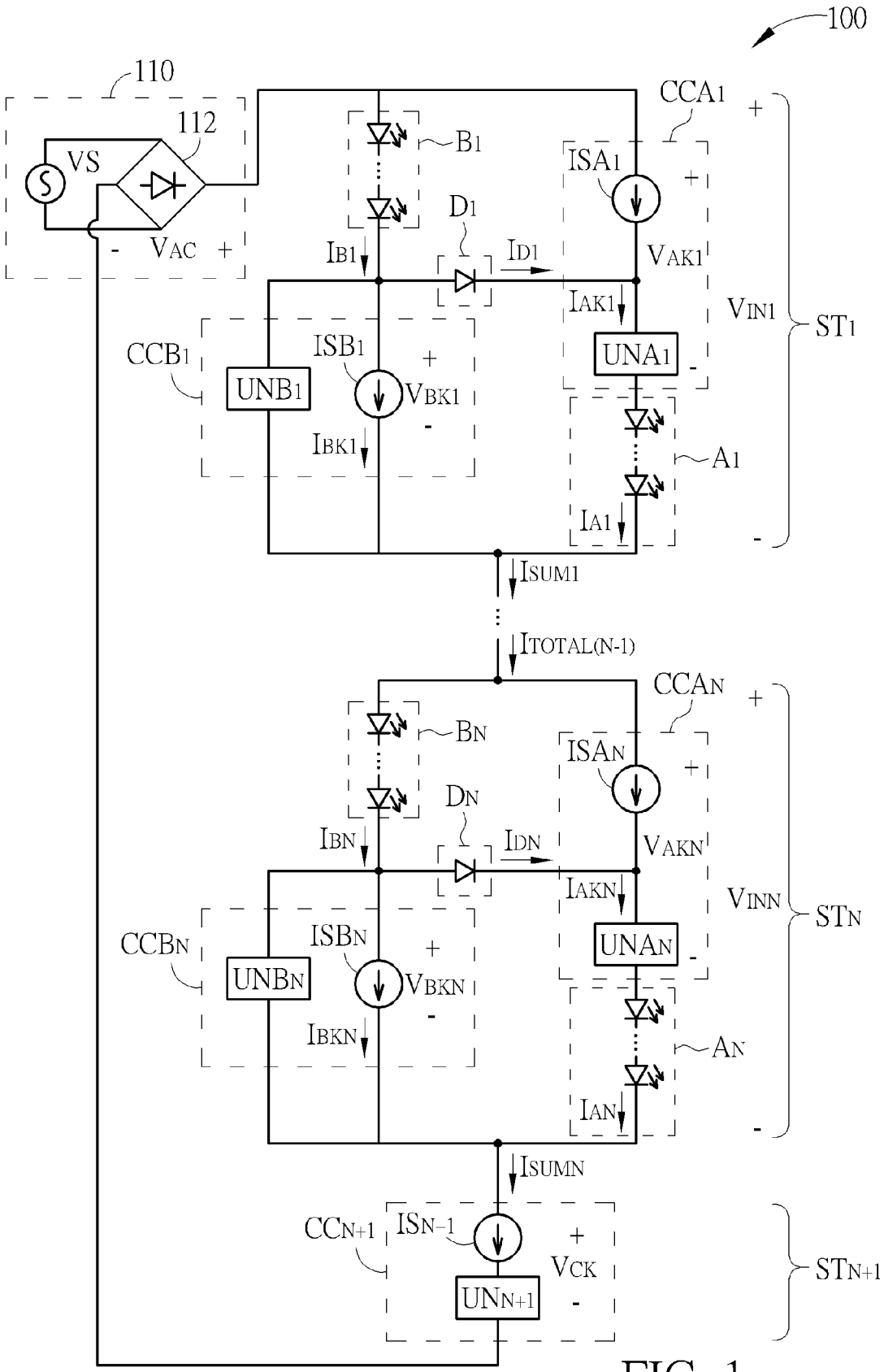
FIG. 1 is a diagram of an LED lighting device according to an embodiment of the present invention.

FIG. 1 is a diagram of an LED lighting device 100 according to an embodiment of the present invention. The LED lighting device 100 includes a power supply circuit 110 and (N+1) driving stages $ST_1$~$ST_{N+1}$ (N is a positive integer). The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for driving the (N+1) driving stages. In another embodiment, the power supply circuit 110 may receive any AC voltage VS, perform voltage conversion using an AC-AC converter, and rectify the converted AC voltage VS using the bridge rectifier 112, thereby providing the rectified AC voltage $V_{AC}$ whose value varies periodically with time. The configuration of the power supply circuit 110 does not limit the scope of the present invention.

Each of the $1^{st}$ to $N^{th}$ driving stages $ST_1$~$ST_N$ includes a plurality of luminescent devices, a path controller, a first-type current controller and a second-type current controller. The $(N+1)^{th}$ driving stage $ST_{N+1}$ includes a third-type current controller. Each first-type current controller includes an adjustable current source and a current detection and control unit. Each second-type current controller includes an adjustable current source and a voltage detection and control unit. The third-type current controller includes an adjustable current source and a detection and control unit.

For illustrative purposes, the following symbols are used to represent each device in the LED lighting device 100 throughout the description and figures. $A_1$~$A_N$ and $B_1$~$B_N$ represent the luminescent devices in the corresponding driving stages $ST_1$~$ST_N$, respectively. $D_1$~$D_N$ represent the path-controllers in the corresponding driving stages $ST_1$~$ST_N$, respectively. $CCA_1$~$CCA_N$ represent the first-type current controllers in the corresponding driving stages $ST_1$~$ST_N$, respectively. $CCB_1$~$CCB_N$ represent the second-type current controllers in the corresponding driving stages $ST_1$~$ST_N$, respectively. $CC_{N+1}$ represents the third-type current controller in the $(N+1)^{th}$ driving stage $ST_{N+1}$. $ISA_1$~$ISA_N$ represent the adjustable current sources in the corresponding first-type current controllers $CCA_1$~$CCA_N$, respectively. $ISB_1$~$ISB_N$ represent the adjustable current sources in the corresponding second-type current controllers $CCB_1$~$CCB_N$, respectively. $IS_{N+1}$ represents the adjustable current source in the third-type current controller $CC_{N+1}$. $UNA_1$~$UNA_N$ represent the current detection and control units in the corresponding first-type current controllers $CCA_1$~$CCA_N$, respectively. $UNB_1$~$UNB_N$ represent the voltage detection and control units in the corresponding second-type current controllers $CCB_1$~$CCB_N$, respectively. $UN_{N+1}$ represents the detection and control unit in the $(N+1)^{th}$ driving stage $ST_{N+1}$.

For illustrative purposes, the following symbols are used to represent related current/voltage in the LED lighting device 100 throughout the description and figures. $V_{IN1}$~$V_{INN}$ represent the voltages established across the $1^{st}$ to $N^{th}$ driving stages $ST_1$~$ST_N$, respectively. $V_{AK1}$~$V_{AKN}$ represent the voltages established across the corresponding first-type current controllers $CCA_1$~$CCA_N$, respectively. $V_{BK1}$~$V_{BKN}$ represent the voltages established across the corresponding second-type current controllers $CCB_1$~$CCB_N$, respectively. $V_{CK}$ represents the voltage established across the third-type current controller $CC_{N+1}$. $I_{AK1}$~$I_{AKN}$ represent the current flowing through the corresponding first-type current controllers $CCA_1$~$CCA_N$, respectively. $I_{BK1}$~$I_{BKN}$ represent the current flowing through the corresponding second-type current controllers $CCB_1$~$CCB_N$, respectively. $I_{A1}$~$I_{AN}$ represent the current flowing through the corresponding luminescent devices $A_1$~$A_N$, respectively. $I_{B1}$~$I_{BN}$ represent the current flowing through the corresponding luminescent devices $B_1$~$B_N$, respectively. $I_{D1}$~$I_{DN}$ represent the current flowing through the corresponding path controllers $D_1$~$D_N$, respectively. $I_{SUM1}$~$I_{SUMN}$ represent the current flowing through the corresponding driving stages $ST_1$~$ST_N$, respectively. The overall current of the LED lighting device 100 may be represented by $I_{SUMN}$.

In the $1^{st}$ to $N^{th}$ driving stages $ST_1$~$ST_N$, the current detection and control units $UNA_1$~$UNA_N$, respectively coupled in series to the corresponding luminescent devices $A_1$~$A_N$ and the corresponding adjustable current sources $ISA_1$~$ISA_N$, are configured to regulate the values of the adjustable current sources $ISA_1$~$ISA_N$ according the current $I_{AK1}$~$I_{AKN}$, respectively. The voltage detection and control units $UNB_1$~$UNB_N$, respectively coupled in series to the corresponding luminescent devices $B_1$~$B_N$ and in parallel with the corresponding adjustable current sources $ISB_1$~$ISB_N$, are configured to regulate the values of the adjustable current sources $ISB_1$~$ISB_N$ according the voltages $V_{BK1}$~$V_{BKN}$, respectively.

In the $(N+1)^{th}$ driving stage $ST_{N+1}$, the adjustable current source $IS_{N+1}$ is coupled in series to the $1^{st}$ to $N^{th}$ driving stages $ST_1$~$ST_N$. In a first configuration, the detection and control unit $UN_{N+1}$ of the third-type current controller $CC_{N+1}$ may be coupled in series to the adjustable current source $IS_{N+1}$ and is configured to regulate the value of the adjustable current source $IS_{N+1}$ according the current $I_{SUMN}$. In a second configuration, the detection and control unit $UN_{N+1}$ of the third-type current controller $CC_{N+1}$ may be coupled in parallel with the adjustable current source $IS_{N+1}$ and is configured to regulate the value of the adjustable current source $IS_{N+1}$ according the voltage $V_{CK}$. FIG. 1 depicts the embodiment adopting the first configuration, but does not limit the scope of the present invention.

In the embodiment of the present invention, each of the luminescent devices $A_1$~$A_N$ and $B_1$~$B_N$ may adopt a single LED or multiple LEDs coupled in series, in parallel, or in array. FIG. 1 depicts the embodiment using multiple LEDs, but do not limit the scope of the present invention.

In the embodiment of the present invention, each of the path-controllers $D_1$~$D_N$ may adopt a diode or any device providing similar function. The embodiment of the path-controllers $D_1$~$D_N$ does not limit the scope of the present invention.

Figure 2:
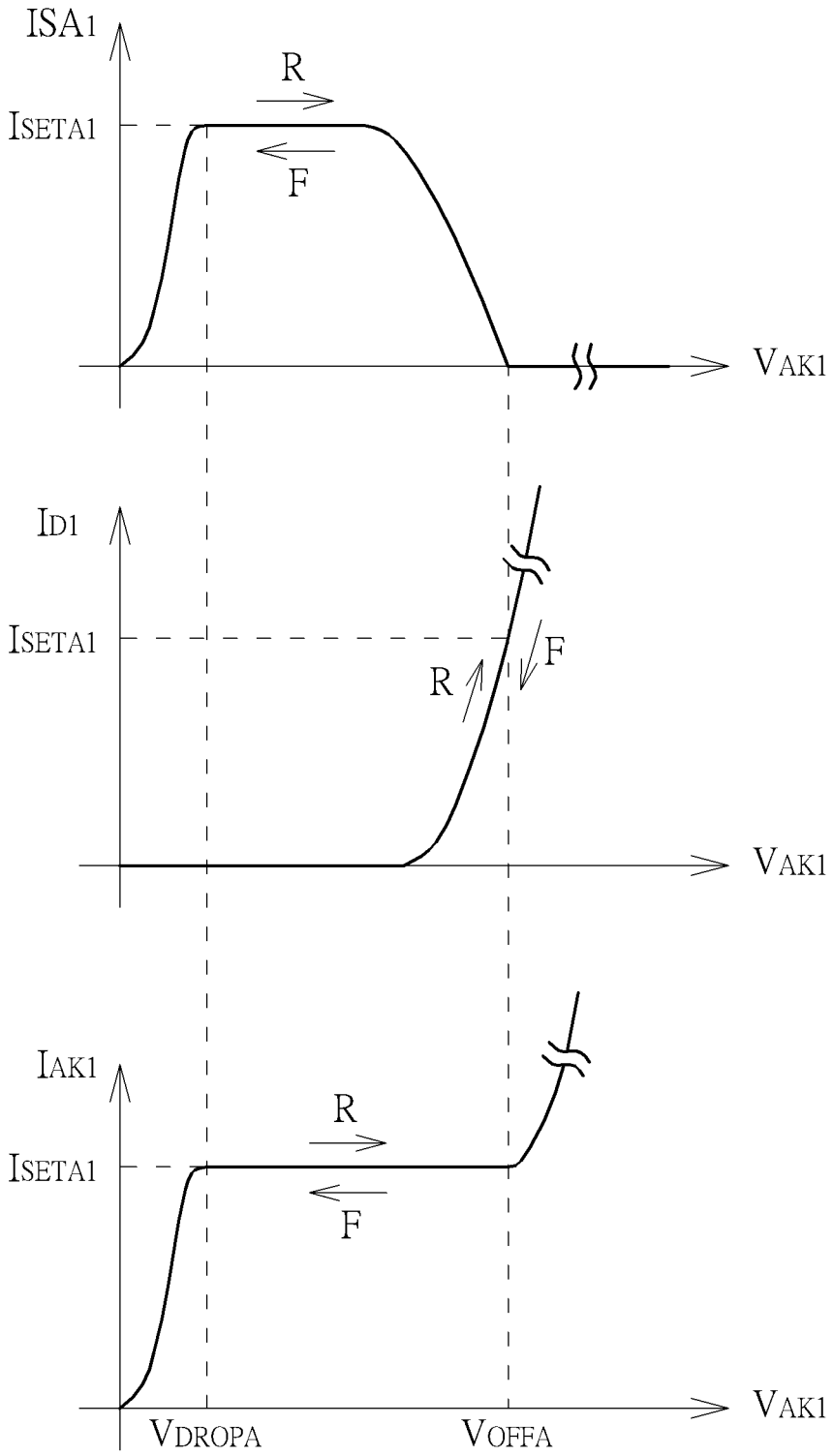
FIGS. 2~6 are diagrams illustrating the operation of the multiple driving stages.
Figure 3:
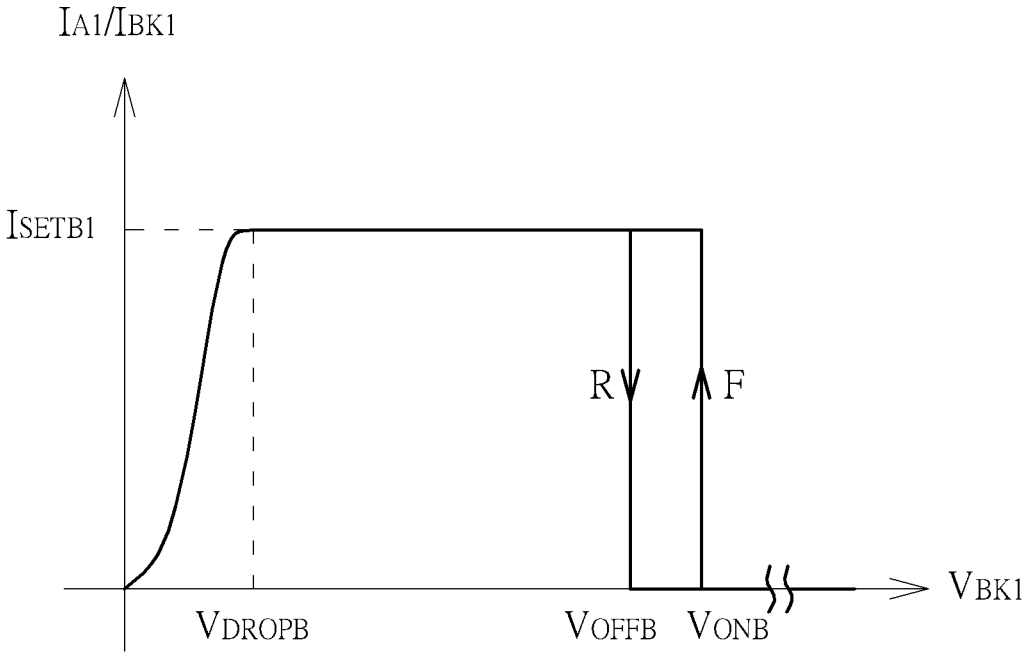
Figure 4:
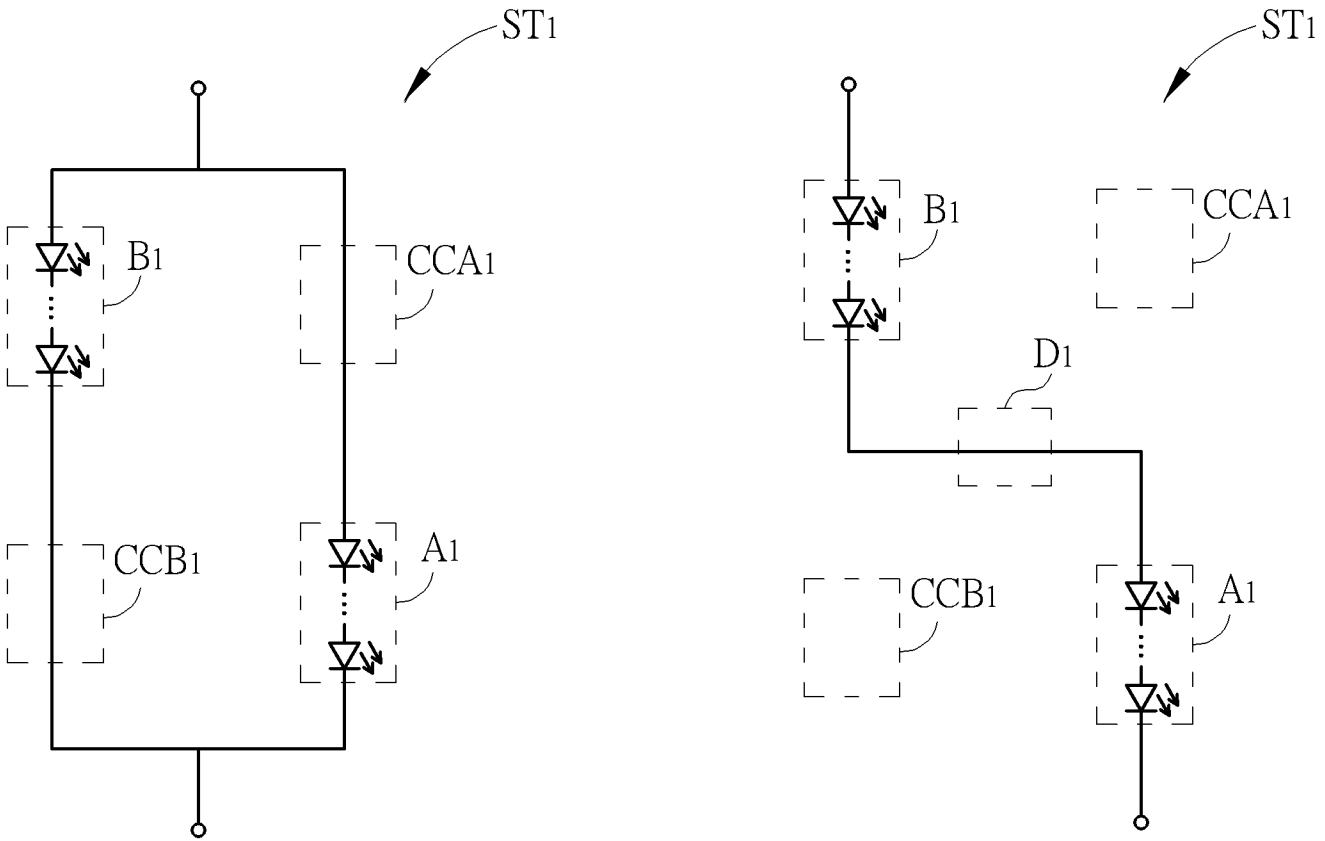
Figure 5:
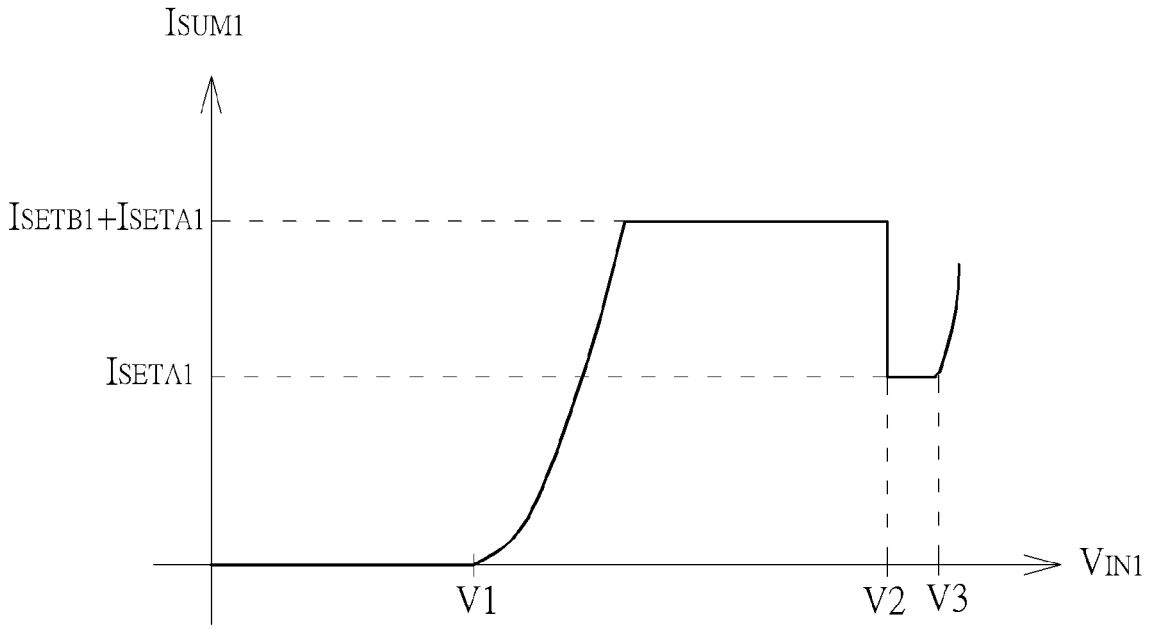
Figure 6:
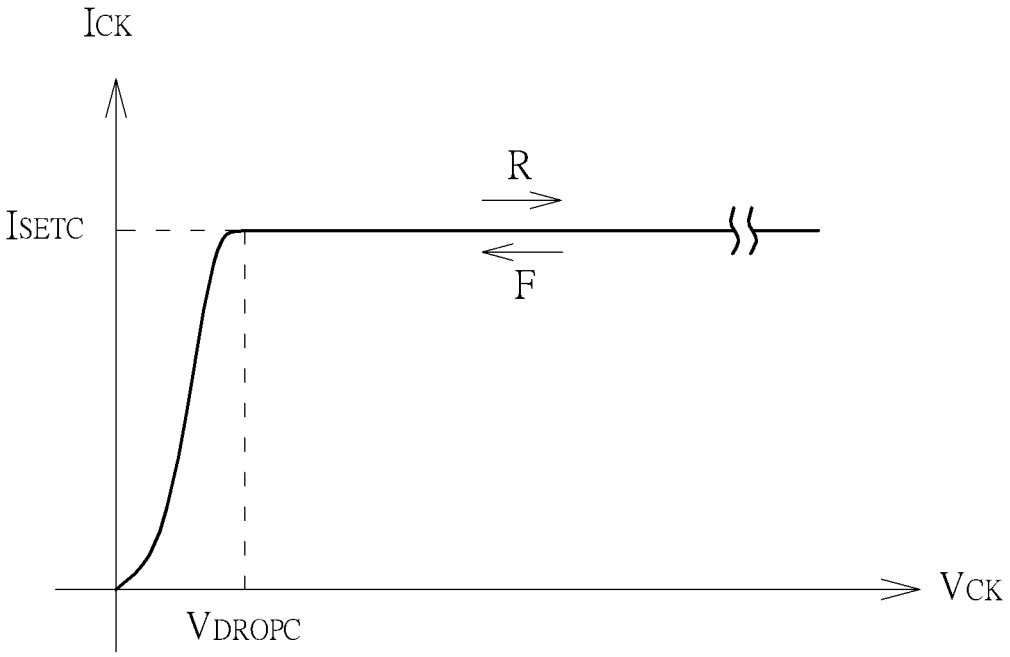

FIGS. 2-5 are diagrams illustrating the operation of the $1^{st}$ to $N^{th}$ driving stages $ST_1$~$ST_N$. The driving stage $ST_1$ is used for illustrative purpose, wherein FIG. 2 illustrates the current-voltage curve (I-V curve) of the first-type current controller $CCA_1$, FIG. 3 illustrates the I -V curve of the second-type current controller $CCB_1$, FIG. 4 illustrates the equivalent circuits of the $1^{st}$ driving stage $ST_1$ during different phases of operation, and FIG. 5 illustrates the I-V curve of the $1^{st}$ driving stage $ST_1$. FIG. 6 is a diagram illustrating the operation of the current controller $CC_{N+1}$ in the $(N+1)^{th}$ driving stages $ST_{N+1}$. $V_{DROPA}$, $V_{DROPB}$ and $V_{DROPC}$ represent the drop-out voltages for turning on the first-type current controller $CCA_1$, the second-type current controller $CCB_1$ and the third-type current controller $CCB_{N+1}$, respectively. $V_{OFFA}$, $V_{OFFB}$ and $V_{ONB}$ represent the threshold voltages based on which the first-type current controller $CCA_1$ or the second-type current controller $CCB_1$ switch operational modes. $I_{SETA1}$, $I_{SETB1}$ and $I_{SETC}$ are constant values which represent the current settings of the first-type current controller $CCA_1$, the second-type current controller and the third-type current controller $CC_{N+1}$, respectively. An arrow R indicates the rising period of the voltage $V_{AK1}$, $V_{BK1}$ or $V_{CK}$. An arrow L indicates the falling period of the voltage $V_{AK1}$, $V_{BK1}$ or $V_{CK}$.

In FIG. 2, during the rising and falling periods of the voltage $V_{AK1}$ when $0<V_{AK1}<V_{DROPA}$, the first-type current controller $CCA_1$ is not completely turned on and operates as a voltage-controlled device in a linear mode in which the current $I_{AK1}$ changes with the voltage $V_{AK1}$ in a specific manner.

During the rising and falling periods of the voltage $V_{AK1}$ when $V_{AK1}>V_{DROPA}$, the current $I_{AK1}$ reaches $I_{SETA1}$, and the first-type current controller $CCA_1$ switches to a constant-current mode and functions as a current limiter. The current detection and control unit $UNA_1$ is configured to clamp the current $I_{AK1}$ at $I_{SETA1}$. For example, in response to an increase in the current $I_{D1}$, the current detection and control unit $UNA_1$ may decrease the value of the adjustable current source $ISA_1$ accordingly. Similarly, in response to a decrease in the current $I_{D1}$, the current detection and control unit $UNA_1$ may increase the value of the adjustable current source $ISA_1$ accordingly. Therefore, the current $I_{AK1}$ ($=I_{D1}+ISA_1$) flowing through the $1^{st}$ driving stage $ST_1$ may be maintained at the constant value $I_{SET1}$ instead of changing with the voltage $V_{AK1}$.

During the rising period of the voltage $V_{AK1}$ before the current $I_{D1}$ reaches $I_{SETA1}$, the current detection and control unit $UNA_1$ turns on the adjustable current source $ISA_1$ and the current controller $CCA_1$ functions as a current limiter in the constant-current mode in which the current $I_{AK1}$ ($=I_{SETA1}+I_{D1}$) is clamped at a constant value of $I_{SETA1}$. When the current $I_{D1}$ reaches $I_{SETA1}$, the current detection and control unit $UNA_1$ turns off the adjustable current source $ISA_1$ and the current controller $CCA_1$ switches to a cut-off mode in which the current $I_{AK1}$ increases with the current $I_{D1}$.

During the falling period of the voltage $V_{AK1}$ before the current $I_{D1}$ drops $I_{SETA1}$, the current detection and control unit $UNA_1$ turns off the adjustable current source $ISA_1$ and the current controller $CCA_1$ operates in the cut-off mode in which the current $I_{AK1}$ decreases with the current $I_{D1}$. When the current $I_{D1}$ drops to $I_{SETA1}$, the current detection and control unit $UNA_1$ turns on the adjustable current source $ISA_1$ and the current controller $CCA_1$ functions as a current limiter in the constant-current mode in which the current $I_{AK1}$ is clamped at a constant value of $I_{SETA1}$.

In FIG. 3, during the rising and falling cycles of the voltage $V_{BK1}$ when $0<V_{BK1}<V_{DROPB}$, the second-type current controller $CCB_1$ is not completely turned on and operates as a voltage-controlled device in the linear mode in which the current $I_{BK1}$ changes with the voltage $V_{BK1}$ in a specific manner.

During the rising period of the voltage $V_{BK1}$ when $V_{BK1}>V_{DROPB}$, the current $I_{BK1}$ reaches $I_{SETB1}$, and the current controller $CCB_1$ switches to the constant-current mode and functions as a current limiter. The voltage detection and control unit $UNB_1$ is configured to clamp the current $I_{BK1}$ at $I_{SETB1}$.

During the rising period of the voltage $V_{BK1}$ when $V_{BK1}>V_{OFFB}$, the voltage detection and control unit $UNB_1$ is configured to turn off the adjustable current source $ISB_1$ and the second-type current controller $CCB_1$ switches to the cut-off mode. In other words, the second-type current controller $CCB_1$ functions as an open-circuited device. During the falling cycle of the voltage $V_{BK1}$ when $V_{BK1}<V_{ONB}$, the voltage detection and control unit $UNB_1$ is configured to turn on the adjustable current source $ISB_1$ and the current controller $CCB_1$ switches to the constant-current mode and functions as a current limiter, thereby clamping the current $I_{BK1}$ at $I_{SETB1}$. The threshold voltage $V_{ONB}$ is larger than or equal to the threshold voltage $V_{OFFB}$. In an embodiment, a non-zero hysteresis band ($V_{ONB}$-$V_{OFFB}$) may be provided in order to prevent the second-type current controller $CCB_1$ from frequently switching operational modes due to fluctuations in the voltage $V_{BK1}$.

In FIG. 4, when the 1st driving stage $ST_1$ operates in a first phase with $V\mathbf{1}<V_{IN1}<V\mathbf{2}$, the luminance device $A_1$ is coupled in parallel with the luminance device $B_1$, as depicted on the left of FIG. 4. When the 1st driving stage $ST_1$ operates in a second phase with $V_{IN1}>V\mathbf{3}$, the luminance device $A_1$ is coupled in series to the luminance device $B_1$, as depicted on the right of FIG. 4.

In FIG. 5, during the rising period when the voltage $V_{IN1}$ is low, the luminance device $A_1$, the luminance device $B_1$ and the path-controller $D_1$ remain off. During the rising period as the voltage $V_{IN1}$ reaches a turn-on voltage $V_{A1}$ which is the sum of the cut-in voltage for turning on the luminance device $A_1$ and the cut-in voltage for turning on the first-type current controller $CCA_1$, the first-type current controller $CCA_1$ and the luminance device $A_1$ are turned on, allowing the current $I_{A1}$ to gradually increase with the voltage $V_{IN1}$ until reaching $I_{SETA1}$; during the rising period as the voltage $V_{IN1}$ reaches a turn-on voltage $V_{B1}$ which is the sum of the cut-in voltage for turning on the luminance device $B_1$ and the cut-in voltage for turning on the second-type current controller $CCB_1$, the second-type current controller $CCB_1$ and the luminance device $B_1$ are turned on, allowing the current $I_{B1}$ to gradually increase with the voltage $V_{IN1}$ until reaching $I_{SETB1}$. With the path controller D1 still off, the current $I_{SUM1}$ is equal to the sum of the current $I_{A1}$ and the current $I_{B1}$, wherein the current $I_{A1}$ is regulated by the current controllers $CCA_1$ and the current $I_{B1}$ is regulated by the current controllers $CCB_1$. The value of the turn-on voltage $V_{A1}$ may be equal to or different from that of the turn-on voltage $V_{B1}$. In other words, the current $I_{SUM1}$ starts to increase at a voltage V1 which is equal to the smaller one among the turn-on voltage $V_{A1}$ and the turn-on voltage $V_{B1}$.

During the rising period when the voltage $V_{IN1}$ reaches V2 so that $V_{BK1}=V_{OFFB}$, the second-type current controller $CCB_1$ switches to the cut-off mode in which the current $I_{A1}$ is directed towards the path-controller $D_1$, thereby turning on the path-controller D1. The current $I_{SUM1}$ is equal to the current $I_{B1}$, wherein both the current $I_{A1}$ and the current $I_{B1}$ are regulated by the first-type current controller $CCA_1$. As the current $I_{A1}$ flows through the path-controller $D_1$, the current $I_{D1}$ gradually increases with the voltage $V_{IN1}$. In response, the first-type current controller $CCA_1$ decreases the value of the adjustable current source $ISA_1$ accordingly, so that the overall current $I_{AK1}$ is still maintained at the constant value $I_{SETA1}$.

When the value of the current source $ISA_1$ drops to zero at $V_{IN1}=V\mathbf{3}$, the first-type current controller $CCA_1$ switches to the cut-off mode. The current $I_{SUM1}$ is now regulated by the subsequent driving stage.

In FIG. 6, during the rising and falling periods of the voltage $V_{CK}$ when $0<V_{CK}<V_{DROPC}$, the third-type current controller $CC_{N+1}$ is not completely turned on and operates as a voltage-controlled device in the linear mode in which the current $I_{CK}$ changes with the voltage $V_{CK}$ in a specific manner. During the rising and falling cycles of the voltage $V_{CK}$ when $V_{CK}>V_{DROPC}$ the current $I_{CK}$ reaches $I_{SETC}$, and the third-type current controller $CC_{N+1}$ switches to the constant-current mode and functions as a current limiter.

Figure 7:
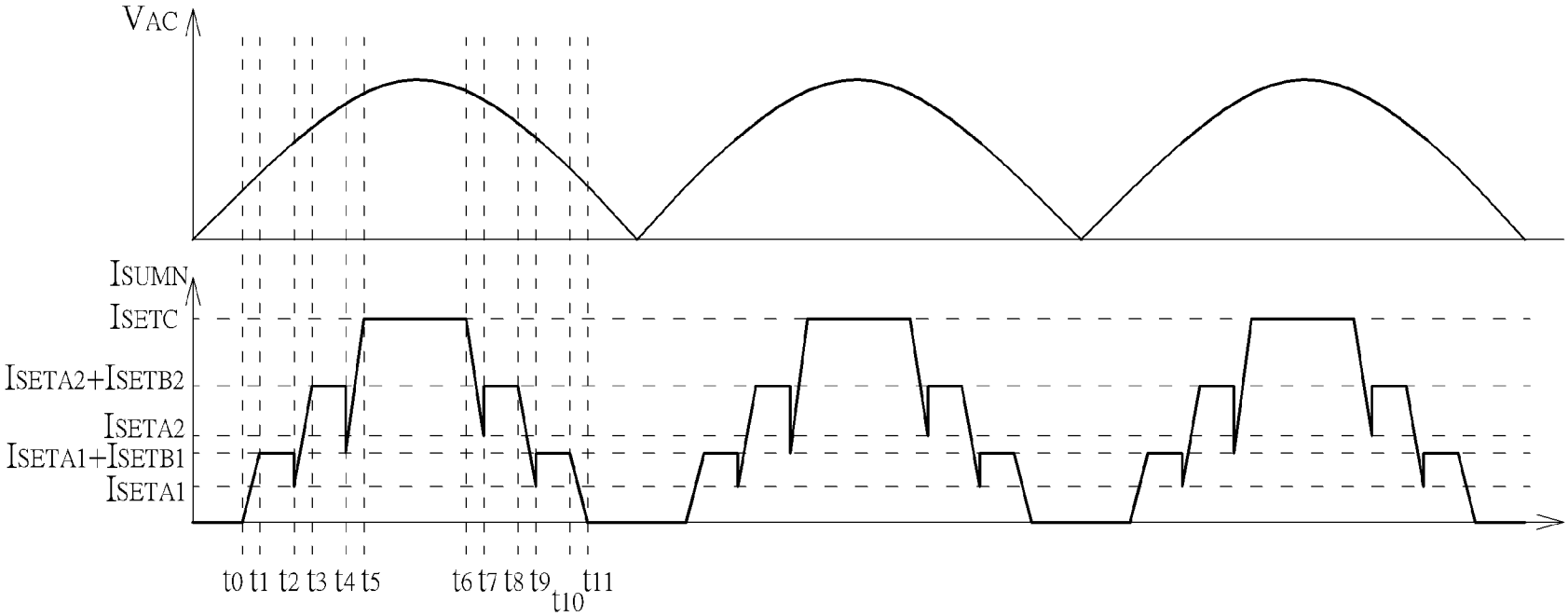
FIG. 7 is a diagram illustrating the overall operation of the LED lighting device according to the present invention.

FIG. 7 is a diagram illustrating the overall operation of the LED lighting device 100 according to the present invention. The embodiment when N=2 is used for illustrative purpose. Since the voltages $V_{IN1}$~$V_{IN2}$, $V_{AK1}$~$V_{AK2}$, $V_{BK1}$~$V_{BK2}$ and $V_{CK}$ are associated with the rectified AC voltage $V_{AC}$ whose value varies periodically with time, a cycle of $t_0$-$t_{11}$ is used for illustration, wherein the period between $t_0$-$t_5$ belongs to the rising period of the rectified AC voltage $V_{AC}$ and the period between $t_6$-$t_{11}$ belongs to the falling period of the rectified AC voltage $V_{AC}$.

Before $t_0$, the rectified AC voltage $V_{AC}$ is low and the voltages $V_{IN1}$~$V_{IN2}$ are insufficient to turn on the luminescent devices $A_1$~$A_2$ and $B_1$~$B_2$ or the current controllers $CCA_1$~$CCA_2$, $CCB_1$~$CCB_2$ and $CC_3$. Therefore, all the 3 driving stages ST1~ST3 operate in the cut-off mode, and the overall current $I_{SUMN}$ of the LED lighting device 100 is zero.

Between $t_0$~$t_1$, all 3 driving stages $ST_1$~$ST_3$ operate in the linear mode in which the overall current $I_{SUMN}$ of the LED lighting device 100 increases with the rectified AC voltage $V_{AC}$ in a specific manner. Between $t_1$~$t_2$, the first driving stage $ST_1$ switches to the constant-current mode and the current $I_{SUM1}$ is maintained at a constant value ($I_{SUM1}=I_{SETA1}+I_{SETB1}$) regardless of the level of the rectified AC voltage $V_{AC}$. Therefore, the overall current $I_{SUMN}$ of the LED lighting device 100 is regulated by the current controllers $CCA_1$ and $CCB_1$ between $t_0$~$t_2$.

Between $t_2$~$t_3$, the first driving stage $ST_1$ switches to the cut-off mode, while the second and third driving stages $ST_2$~$ST_3$ remain operating in the linear mode in which the overall current $I_{SUMN}$ of the LED lighting device 100 increases with the rectified AC voltage $V_{AC}$ in a specific manner. Between $t_3$~$t_4$, the second driving stage $ST_2$ switches to the constant-current mode and the current $I_{SUM2}$ is maintained at a constant value ($I_{SUM2}=I_{SETA2}+I_{SETB2}$) regardless of the level of the rectified AC voltage $V_{AC}$. Therefore, the overall current $I_{SUMN}$ of the LED lighting device 100 is regulated by the current controllers $CCA_2$ and $CCB_2$ between $t_2$~$t_4$.

Between $t_4$~$t_5$, the second driving stage $ST_2$ switches to the cut-off mode, while the third driving stage $ST_3$ remain operating in the linear mode in which the overall current $I_{SUMN}$ of the LED lighting device 100 increases with the rectified AC voltage $V_{AC}$ in a specific manner. Between $t_5$~$t_6$, the third driving stage $ST_3$ switches to the constant-current mode and the current $I_{SUMN}$ is maintained at a constant value ($I_{SUMN}=I_{SETC}$) regardless of the level of the rectified AC voltage $V_{AC}$. Therefore, the overall current $I_{SUMN}$ of the LED lighting device 100 is regulated by the current controller $CC_3$.

The intervals $t_0$~$t_1$, $t_1$~$t_2$, $t_2$~$t_3$, $t_3$~$t_4$ and $t_4$~$t_5$ during the rising period correspond to the intervals $t_{10}$~$t_{11}$, $t_9$~$t_{10}$, $t_8$~$t_9$, $t_7$·$t_8$ and $t_6$~$t_7$ during the falling period, Therefore, the operation of the LED lighting device 100 during $t_6$-$t_{11}$ is similar to that during $t_0$~$t_5$, as detailed in previous paragraphs.

In an embodiment of the present invention, the current settings of the LED lighting device 100 may have the following relationship: $(I_{SETA1}+I_{SETB1})<(I_{SETA2}+I_{SETB2})<I_{SETC}$.

The following table summarizes the operational modes and phases of the $1^{st}$ to $3^{rd}$ driving stages $ST_1$~$ST_3$, wherein mode 1 represents the linear mode, mode 2 represents the constant-current mode, and mode 3 represents the cut-off mode. Phase 1 and phase 2 respectively represent the first phase and the second phase in the operation of the equivalent circuits of the $1^{st}$ driving stage $ST_1$ depicted in FIG. 4.

| | t0~t1<br>t10~t11 | t1~t2<br>t9~t10 | t2~t3<br>t8~t9 | t3~t4<br>t7~t8 | t4~t5<br>t6~t7 | t5~t6 |
|---|---|---|---|---|---|---|
| $1^{st}$ driving stage | mode 1 | mode 2 | mode 3 | mode 3 | mode 3 | mode 3 |
| | phase 1 | | | phase 2 | | |
| $2^{nd}$ driving stage | mode 1 | mode 1 | mode 1 | mode 2 | mode 3 | mode 3 |
| | | phase 1 | | | phase 2 | |
| $3^{rd}$ driving stage | mode 1 | mode 1 | mode 1 | mode 1 | mode 1 | mode 2 |

Figure 8:
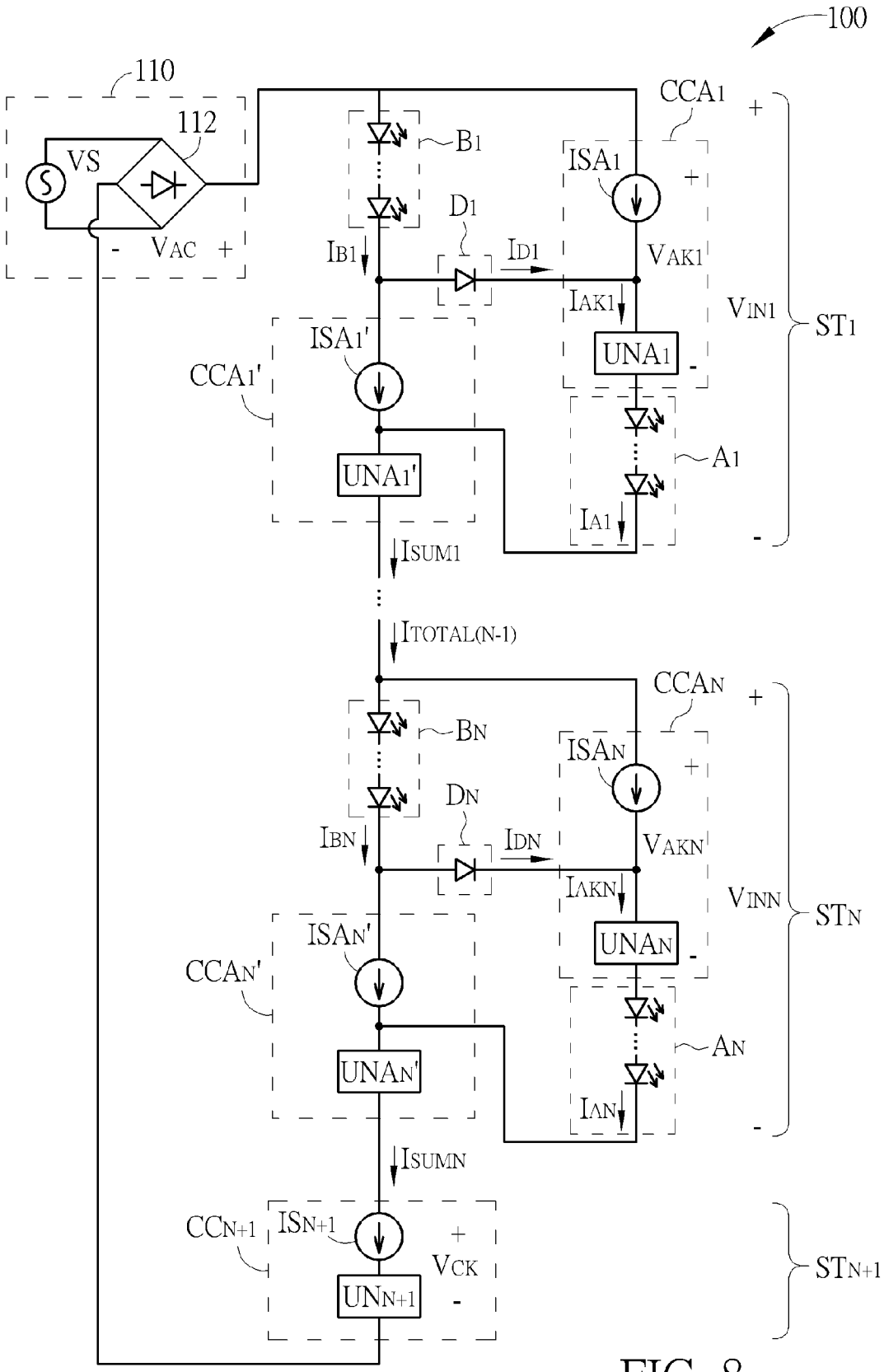
FIG. 8 is a diagram of an LED lighting device according to another embodiment of the present invention.

FIG. 8 is a diagram of an LED lighting device 200 according to another embodiment of the present invention. Similar to the LED lighting device 100 depicted in FIG. 1, the LED lighting device 200 also includes a power supply circuit 110 and (N+1) driving stages $ST_1$~$ST_{N+1}$ (N is a positive integer). However, the LED lighting device 200 differs from the LED lighting device 100 in that each of the $1^{st}$ to $N^{th}$ driving stages $ST_1$~$ST_N$ includes a plurality of luminescent devices, a path controller, and two first-type current controllers. Each first-type current controller includes an adjustable current source and a current detection and control unit, and its I-V curve may also be shown in FIG. 2. In the first-type current controller represented by $CCA_1$~$CCA_N$, the current detection and control units $UNA_1$~$UNA_N$, respectively coupled in series to the corresponding luminescent devices $A_1$~$A_N$ and the corresponding adjustable current sources $ISA_1$~$ISA_N$, are configured to regulate the values of the adjustable current sources $ISA_1$~$ISA_N$ according the current $I_{AK1}$~$I_{AKN}$, respectively. In the first-type current controller represented by $CCA_1'$~$CCA_N'$, the current detection and control units $UNA_1'$~$UNA_N'$, respectively coupled in series to the corresponding luminescent devices $B_1$~$B_N$ and the corresponding adjustable current sources $ISA_1'$~$ISA_N'$, are configured to regulate the values of the adjustable current sources $ISA_1'$~$ISA_N'$ according the current $I_{BK1}$~$I_{BKN}$, respectively. The overall operation of the LED lighting device 200 may also be shown in FIG. 7.

With the above-mentioned multi-stage driving scheme, all luminance devices may be simultaneously light up and the overall current may be flexibly regulated by corresponding current controllers. Therefore, the LED lighting device of the present invention may improve the effective operational voltage range without causing image flicker and uniformity issue.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting device having multiple driving stages, comprising:

a first driving stage including:

a first luminescent device for providing light according to a first current;

a second luminescent device for providing light according to a second current;

a first current controller coupled in series to the first luminescent device and configured to regulate the first current so that the first current does not exceed a first value;

a second current controller coupled in series to the second luminescent device and configured to regulate the second current so that the second current does not exceed a second value;

a first path-controller configured to conduct a third current and comprising:

a first end coupled between the second luminescent device and the second current controller; and a second end coupled to the first current controller; and a second driving stage including:

a third current controller coupled in series to the first driving stage and configured to conduct a fourth current and regulate the fourth current so that the fourth current does not exceed a third value.

2. The LED lighting device of claim 1, wherein:

during a rising period or a falling period of a rectified alternative-current (AC) voltage when the voltage established across the first current controller does not exceed a first voltage, the first current controller operates in a first mode in which the first current changes with the voltage established across the first current controller;

during the rising period or the falling period when the third current does not exceed the first value, the first current controller operates in a second mode in which the first current is maintained at the first value; and during the rising period or the falling period when the third current exceeds the first value, the first current controller operates in a third mode in which the first current controller is turned off.

3. The LED lighting device of claim 1, wherein:

during a rising period or a falling period of a rectified AC voltage when the voltage established across the third current controller does not exceed a sixth voltage, the third current controller operates in a first mode in which the fourth current changes with the voltage established across the second current controller; and during the rising period or the falling period when the voltage established across the third current controller exceeds the sixth voltage, the third current controller operates in a second mode in which the fourth current is maintained at the third value.

4. The LED lighting device of claim 1, wherein the first current controller includes:

a first adjustable current source configured to conduct a fifth current; and a first detection and control unit configured adjust the fifth current according to the first current or the third current, and comprising:

a first end coupled to the second end of the first path-controller and the first adjustable current source; and a second end coupled to the first luminescent device.

5. The LED lighting device of claim 1, wherein the second current controller includes:

a second adjustable current source configured to conduct a sixth current; and a second detection and control unit coupled in parallel with the second adjustable current and configured adjust the sixth current according to a voltage established across the second current controller.

6. The LED lighting device of claim 1, wherein:

the first current controller includes:

a first adjustable current source configured to conduct a fifth current; and a first detection and control unit configured adjust the fifth current according to the first current or the third current, and comprising:

a first end coupled to the second end of the first path-controller and the first adjustable current source; and a second end coupled to the first luminescent device; and the second current controller includes:

a second adjustable current source configured to conduct a sixth current; and a second detection and control unit coupled in series to the second adjustable current and configured adjust the sixth current according to the second current or the third current.

7. The LED lighting device of claim 1, wherein the third current controller includes:

a third adjustable current source configured to conduct the fourth current; and a third detection and control unit coupled in series to the third adjustable current source and configured to control the third adjustable current source according to the fourth current.

8. The LED lighting device of claim 1, further comprising a third driving stage coupled between the first driving stage and the second driving stage, and includes:

a third luminescent device for providing light according to a seventh current;

a fourth luminescent device for providing light according to an eighth current;

a fourth current controller coupled in series to the third luminescent device and configured to regulate the seventh current so that the seventh current does not exceed a fourth value;

a fifth current controller coupled in series to the fourth luminescent device and configured to regulate the eighth current so that the eighth current does not exceed a fifth value; and a second path-controller configured to conduct a ninth current and comprising:

a first end coupled between the fourth luminescent and the fifth current controller; and a second end coupled to the fourth current controller.

9. The LED lighting device of claim 1, wherein the first path-controller includes a diode.

10. The LED lighting device of claim 1, wherein:

the first luminescent is coupled in parallel with the second luminescent when the first path-controller is turned off; and the first luminescent is coupled in series to the second luminescent when the first path-controller is turned on.

11. The LED lighting device of claim 1, wherein:

when the first path-controller is turned off, the third current is zero, and the fourth current is equal to a sum of the first current and the second current; and when the first path-controller is turned on, the first current, the second current, the third current and the fourth current is equal.

12. The LED lighting device of claim 1, wherein:

during a rising period or a falling period of a rectified AC voltage when a voltage established across the second current controller does not exceed a third voltage, the second current controller operates in a first mode in which the second current changes with the voltage established across the second current controller;

during the rising period when the voltage established across the second current controller exceeds the third voltage but does not exceed a fourth voltage, the second current controller operates in a second mode in which the second current is maintained at the second value; and during the rising period when the voltage established across the second current controller exceeds the fourth voltage, the second current controller operates in a third mode in which the second current controller is turned off.

13. The LED lighting device of claim 12, wherein:

during the falling period when the voltage established across the second current controller exceeds the third voltage but does not exceed a fifth voltage, the second current controller operates in the second mode in which the second current is maintained at the second value, and the fifth voltage is larger than or equal to the fourth voltage.

14. The LED lighting device of claim 1, further comprising a power supply circuit configured to provide a rectified AC voltage for driving the first luminescent device and the second luminescent device.

15. The LED lighting device of claim 14, wherein the power supply circuit includes an AC-AC voltage converter.

* * * * *